US011982076B2

(12) United States Patent
Kwacz et al.

(10) Patent No.: US 11,982,076 B2
(45) Date of Patent: May 14, 2024

(54) MAGNETIC WATER MOVEMENT

(71) Applicant: Kohler Co., Kohler, WI (US)

(72) Inventors: Jason Kwacz, Kohler, WI (US); Yunjie Zhang, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 20 days.

(21) Appl. No.: 17/736,416

(22) Filed: May 4, 2022

(65) Prior Publication Data

US 2022/0356689 A1 Nov. 10, 2022

Related U.S. Application Data

(60) Provisional application No. 63/184,519, filed on May 5, 2021.

(51) Int. Cl.
*E03D 5/10* (2006.01)
*E03D 5/01* (2006.01)

(52) U.S. Cl.
CPC *E03D 5/10* (2013.01); *E03D 5/01* (2013.01)

(58) Field of Classification Search
CPC .. E03D 5/10; E03D 5/01; E03D 11/00; E03D 11/02; E03D 11/13
See application file for complete search history.

(56) References Cited

U.S. PATENT DOCUMENTS

| | | | | |
|---|---|---|---|---|
| 2,599,765 | A | 6/1952 | Kumnick | |
| 5,349,985 | A * | 9/1994 | Fischer | E03C 1/057 290/52 |
| 5,640,724 | A | 6/1997 | Holmes | |
| 9,670,657 | B2 | 6/2017 | Lee | |
| 9,797,121 | B2 * | 10/2017 | Francis | E03C 1/302 |
| 10,890,277 | B2 | 1/2021 | Chung et al. | |
| 2013/0247292 | A1 * | 9/2013 | Jefferson | E03D 11/00 4/427 |
| 2015/0013056 | A1 * | 1/2015 | Lee | E03D 11/10 4/348 |
| 2018/0313073 | A1 * | 11/2018 | Main | H04Q 9/00 |
| 2019/0264849 | A1 | 8/2019 | Chung | |

FOREIGN PATENT DOCUMENTS

| | | | | |
|---|---|---|---|---|
| CN | 108222170 | B | 9/2019 | |
| CN | 210767061 | U | 6/2020 | |
| CN | 111472427 | A | 7/2020 | |
| IN | 211057955 | U | 7/2020 | |
| JP | 2000157943 | A | 6/2000 | |
| JP | 3247942 | B2 | 1/2002 | |
| KR | 20110052110 | A * | 5/2011 | E03D 11/13 |
| KR | 101400086 | B1 | 5/2014 | |

* cited by examiner

*Primary Examiner* — Christine J Skubinna
(74) *Attorney, Agent, or Firm* — Lempia Summerfield Katz LLC

(57) ABSTRACT

Disclosed are devices, methods, and systems for generating and applying a magnetic field in a toilet. A toilet including a bowl having a discharge outlet, a trapway in fluid communication with the discharge outlet, and at least one magnet configured to generate a magnetic field to alter a flow of liquid through the trapway is described.

19 Claims, 15 Drawing Sheets

MAGNETIC WATER MOVEMENT

CROSS-REFERENCE TO RELATED APPLICATIONS

This application claims priority benefit of Provisional Application No. 63/184,519 (Docket No. 010222-21007A-US) filed on May 5, 2021, which is hereby incorporated by reference in its entirety.

FIELD

The present application relates generally to devices and methods for employing magnets to move liquids. More specifically, the present application relates to devices and methods employing magnets to move liquids in a toilet.

BACKGROUND

In consideration of environmental and economic concerns, more efficient toilets that use less water are being designed and manufactured. One method of decreasing the amount of water used by a toilet is to decrease the amount of water that is released during each operation of a flush cycle. However, decreasing the amount of water released during a flush cycle reduces the flushing power of the flush cycle, reducing the ability of the flush cycle to remove waste from the toilet. Accordingly, there is a need for a method of increasing flushing power in a low-flush toilet that uses a reduced amount of water during a flush cycle.

BRIEF DESCRIPTION OF THE DRAWINGS

Objects, features, and advantages of the present disclosure should become more apparent upon reading the following detailed description in conjunction with the figures, in which.

DETAILED DESCRIPTION

Before turning to the figures, which illustrate certain exemplary embodiments in detail, it should be understood that the present disclosure is not limited to the details and methodology set forth in the detailed description or illustrated in the figures. It should be understood that the terminology used herein is for the purpose of description only and should not be regarded as limiting.

When a component, element, device, or the like of the present disclosure is described as having a purpose or performing an operation, function, or the like, the component, device, or element should be considered herein as being "configured to" meet that purpose or perform that operation or function.

Described herein are devices, methods, and systems employing a magnetic field to alter a flow of liquid through a toilet. Magnetic fields may be used to either directly or indirectly alter the flow of liquid through a toilet during a flush cycle. A magnetic field may directly alter the flow of water through a toilet by repelling the liquid flowing through the toilet. A magnetic field may indirectly alter a flow of liquid through a toilet by actuating a device to propel the liquid through the toilet. A magnetic field may be used to assist a flow of liquid through a toilet during a flush cycle, increasing the flushing power of the toilet. Specifically, a magnetic field may be used in a low-flush toilet to increase the flushing power of the low-flush toilet. A low-flush toilet may be, for example, a toilet that uses less than 1.6 US gallons per flush. A low-flush toilet may be, for example, a toilet that uses 1.28 or less US gallons per flush.

The magnetic field may be generated (e.g., created, produced) by a magnet. A magnet is a material or object that creates a magnetic field. A permanent magnet is an object or material that is magnetized and creates its own magnetic field. A temporary magnet only maintains its magnetic field at certain times such as when in the presence of a permanent magnetic field or electric current. Although ferromagnetic materials (e.g., iron, nickel, cobalt) are the only materials attracted to a magnet strongly enough to be considered magnetic, other materials respond weakly to magnetic fields. Typically, magnetic fields have negligible impact on non-ferromagnetic materials; however, small forces applied in specific situations may provide useful features in the following embodiments. Specifically, diamagnetic materials, such as water, are always repelled by a magnetic field. Diamagnetic materials have mostly paired electrons and are repelled by both a north pole and a south pole of a magnet. Described herein are devices, methods, and systems employing a magnetic field to directly or indirectly alter a flow of liquid, such as water, through a toilet.

Figure 1:
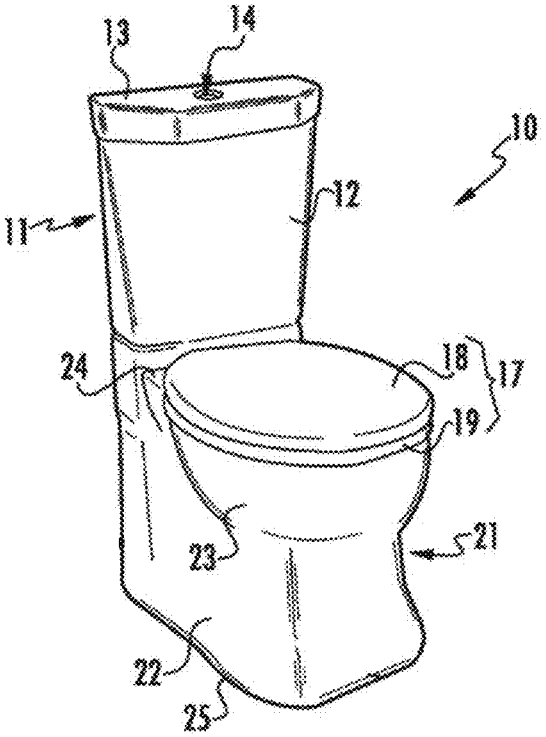
FIG. 1 is a perspective view of a toilet, according to an exemplary embodiment of the present disclosure.
Figure 2:
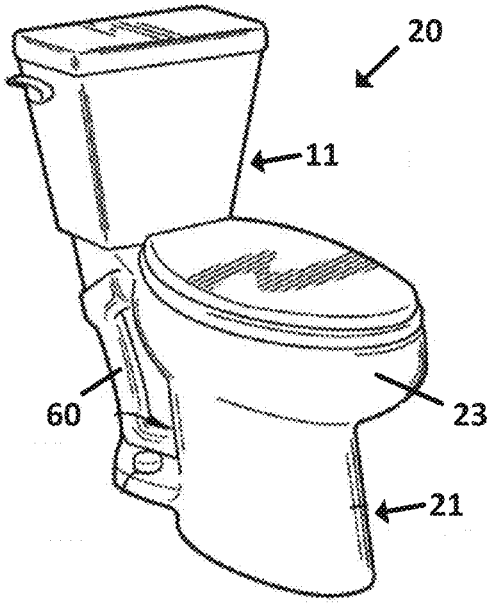
FIG. 2 is a perspective view of a toilet, according to another exemplary embodiment of the present disclosure.

FIGS. 1 and 2 illustrate toilets according to exemplary embodiments of the present disclosure. FIG. 1 illustrates an exemplary embodiment of a skirted toilet 10 that includes a tank 11, a pedestal 21 (or base), a seat assembly 17 and a coupling or mounting assembly (not shown). The tank 11 may include a hollow reservoir 12 for storing the water used during operational (or flushing) cycles, a lid (or cover) 13 for providing selective access into the reservoir 12, and an actuator 14 that is configured to initiate an operational cycle when activated. The actuator 14 or flush mechanism may be a button configured to activate when depressed (or pulled) a predetermined distance or when touched, a lever configured to activate when rotated a predetermined angular travel, or any suitable device configured to activate based upon an input manipulation by a user.

It should be noted that the shapes and configurations of the tank, pedestal, seat assembly, and the internal components (including the trapway and other features) may vary from the embodiments shown and described herein, and that the embodiments disclosed herein are not intended as limitations. It should be noted that various components of the toilet may be made of vitreous china. It should be noted that various components of the toilet may be polymeric and/or over molded or otherwise fixed to the toilet. It should be noted, for example, that although the exemplary embodiment of the toilet 10 is shown configured with the tank 11 formed separately from the pedestal 21 and later coupled to the pedestal, the tank may be integrally formed with the pedestal as a one-piece design. In other words, the toilet may be a one-piece design, a two-piece design, or have any suitable configuration. The toilet disclosed herein may have a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The tank 11 may include an inlet opening (not shown) configured to receive water from a coupled water supply (not shown), such as from a hose (e.g., line, tube). The tank 11 may also include an inlet valve assembly (not shown) or other device configured to control the flow of water from the water supply into the tank through the inlet opening. Within the tank 11 may be provided a float device (not shown) for controlling the inlet valve assembly, such as by opening the valve to refill the reservoir 12 of the tank 11 after an operational cycle and closing the valve when the water in the reservoir 12 reaches a preset volume or height. The tank 11 may also include an outlet opening (not shown) configured to transfer (e.g., conduct) the water stored in the reservoir 12 of the tank to the pedestal 21 upon activation of the actuator 14. The pedestal 21 may include toilet bowl 23. The tank 11 may include an outlet valve assembly (not shown) or other device configured to control the flow of water from the tank into the pedestal 21 through the outlet opening.

The pedestal 21 (or base) of the toilet 10 may include a wall 22 having any suitable shape that is configured to form a bowl 23 having an opening formed by an upper rim at the top of the opening. The pedestal 21 may also be configured to include a plurality of walls having varying shapes that together form a bowl having an opening formed by a rim. The wall 22 of the pedestal may extend downward and/or rearward from the bowl 23 to form a lower portion 25 configured to support the pedestal 21 and the toilet 10. The lower portion 25 may be formed by the end (e.g., lower rim) of the wall 22, or may include a member that extends generally in a horizontal plane from one or more than one end of the wall. The pedestal 21 may also include a top member 24 that extends between two sides of the wall 22 (or between two opposing walls) and is provided rearward (or behind) the bowl 23, wherein the top member 24 forms a plateau for supporting the tank 11, such as the bottom surface of the reservoir 12 of the tank 11. The top member 24 may include an inlet opening that may be aligned with the outlet opening of the tank 11, such as when the tank 11 is coupled to (or resting above) the pedestal 21, wherein water is selectively transferred (e.g., conducted) from the tank 11 through the outlet opening of the tank to the pedestal 21 through the inlet opening of the pedestal 21, when the toilet is activated through the actuator 14. The outlet valve assembly may control the flow of water from the tank to the pedestal. The toilet may also include a gasket or seal that is provided between the tank 11 and the pedestal 21 to prohibit leaking. For example, a gasket may be provided between the outlet opening of the tank and the inlet opening of the pedestal to prohibit leaking between the tank and the pedestal.

The plateau formed by the top member 24 of the pedestal 21 may also provide for coupling of the seat assembly 17 to the pedestal 21 of the toilet 10. For example, the top member 24 may include one or more than one opening, wherein each opening is configured to receive a fastening device (e.g., bolt, screw, etc.) to couple (e.g., attach) the seat assembly 17 to the top member 24 of the pedestal 21. As another example, the top member 24 may include one or more than one fastening device (e.g., bolts, recessed nuts, etc.) integrally formed therein (i.e., already provided connected or coupled to the pedestal 21), wherein the fastening device may be used to couple or secure at least a portion of the seat assembly 17 to the pedestal 21.

The bowl 23 of the pedestal 21 may be configured to include a receptacle (e.g., sump) and an outlet opening, wherein the water and waste is collected in the receptacle until being removed through the outlet opening, such as upon activation of the actuator 14. The pedestal 21 may also include a pedestal internal passageway, such as a trapway, that connects the outlet opening or discharge outlet of the bowl 23 to a drain or soil pipe. The passageway, or trapway, generally includes a first portion, a second portion, and a weir separating the first and second portions. The first portion of the passageway may extend from the outlet opening of the bowl 23 at an upwardly oblique angle to the weir. The second portion of the passageway may extend from the weir downwardly to the exiting device, such as the drain or soil pipe.

Between operational cycles (e.g., flush cycles) of the toilet 10, the water (and waste) is collected in the first portion of the trapway (in addition to the receptacle of the bowl), such that the weir prohibits the water from passing past the weir and into the second portion of the trapway. A flushing cycle may begin upon activation of the actuator 14. Upon activation of the actuator, additional water may be discharged from the tank 11 into the bowl 23 of the pedestal 21, resulting in the flushing action and waste removal through the soil pipe. The flushing cycle may include generation of a siphon to assist the flushing action and waste removal.

The seat assembly 17 may include a cover member 18 (e.g., lid), a seat member 19 (e.g., ring member), and a hinge. The seat member 19 may be configured to include an annular member that encircles an opening, wherein the annular member provides a seating surface for the user of the toilet 10. The seat member 19 may also be pivotally coupled (e.g., attached) to the hinge, wherein the seat member may rotate (or pivot) about the hinge, such as between a first lowered or seated position and a second raised or upright position. The cover member 18 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 18 may also be coupled to the hinge, wherein the cover member may rotate (or pivot) about the hinge, such as between a first down lowered or down position and a second raised or upright position. The cover member 18 may be provided above the seat member in the down position to thereby cover the opening of the seat member 19, as well as to conceal the inside of the bowl 23 of the pedestal 21. The cover member 18 may be configured to rest against the outside surface of the tank 11, when the cover member 18 is in the upright position, such that the cover member 18 remains in the upright position in order for a user to sit upon the seat member 19.

FIG. 2 illustrates a non-skirted toilet 20 according to another exemplary embodiment of the present disclosure. The internal components, including the trapway 60, are visible in the pedestal 21 of non-skirted toilet 20. It should be noted that the devices, methods, and systems described herein may include and/or be used with both skirted and non-skirted toilets.

Figure 3:
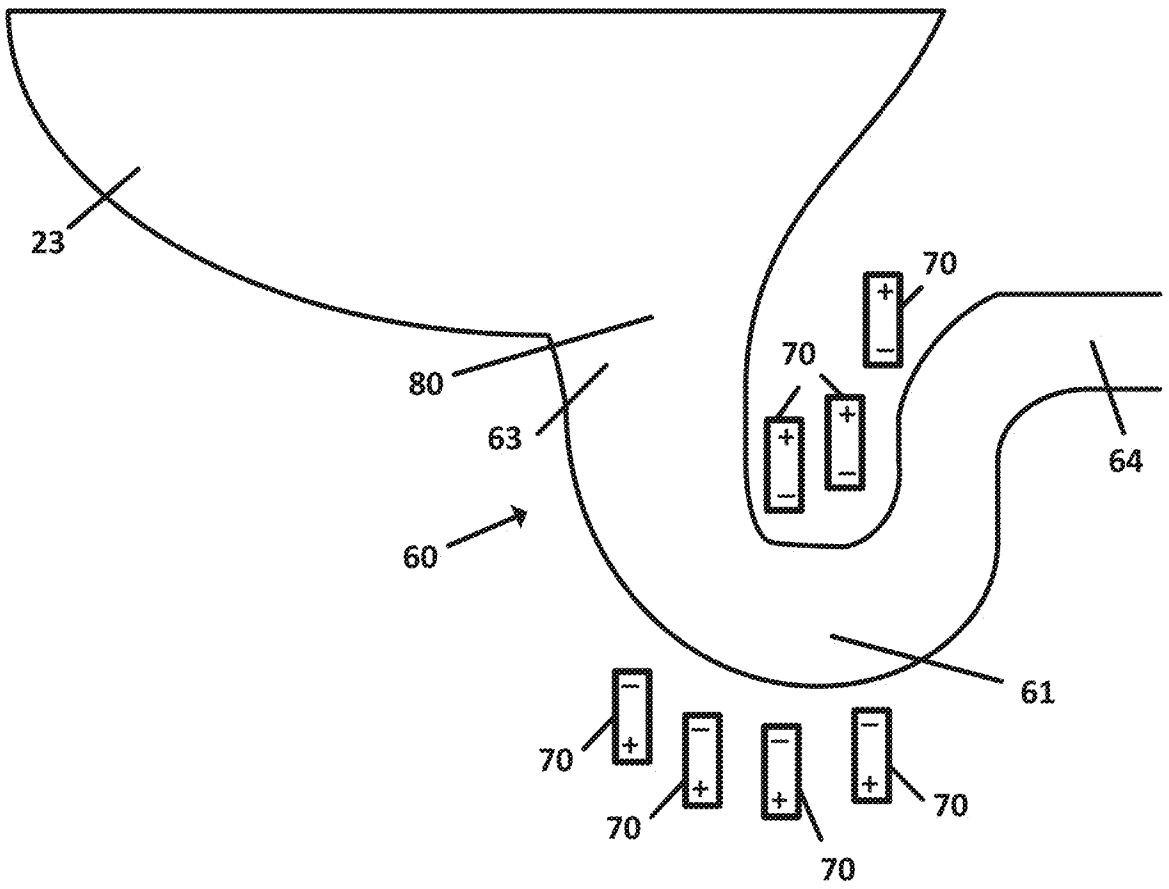
FIG. 3 is a sideview of a trapway according to an exemplary embodiment of the present disclosure.

FIG. 3 illustrates a sideview of a trapway 60 according to an exemplary embodiment of the present disclosure. The trapway 60 includes a hollow trap passageway 61 extending from a first end 63 to a second end 64. The trapway 60 may be made from a polymer or composite material through a molding process (e.g., injection molding), may be made from a metal (e.g., steel, cast iron, etc.) through a casting or other forming process, or may be made from any suitable material through any suitable process as may be appropriate or desired for a given application. In some embodiments, the trapway 60 may be integrally formed with the bowl 23. In other embodiments, the trapway 60 and the bowl 23 may be separate members connected (e.g., structurally, fluidly) to one another. In some embodiments, the trapway may comprise two or more separate members connected (e.g., structurally, fluidly) to on another to form the trapway 60.

The first end 63 of the trap passageway 61 is connected to or integrally formed with the bowl 23. The trap passageway 61 is fluidly coupled to the bowl 23 so that fluid and waste may travel from the bowl 23 through the discharge outlet 80 of the bowl 23 into the trap passageway 61. The discharge outlet 80 is an outlet of the bowl 23 through which liquid and/or waste is discharged from the bowl 23 into the trapway 61. The second end 64 of the trap passageway 61 is configured to be coupled to a drain or soil pipe, which may be provided in the floor or wall, fluidly and structurally connecting the trap passageway 61 to the building spoil or drainpipe. Thus, liquid and/or waste may pass from the bowl 23 through the trap passageway 61 to the drain or soil pipe during a flush cycle of the toilet. The trap passageway may have an "S" shape or a "P" shape (e.g., the trap may be an s-trap or a p-trap).

FIG. 3 illustrates a trapway 60 having a "P" shape and including at least one magnet 70 configured to generate a magnetic field to alter a flow of liquid (e.g., water) through the trap passageway 61. The trapway 60 maybe the trapway 60 of a toilet including a bowl 23 having a discharge outlet 80, trapway 60 in fluid communication with the discharge outlet 80, and at least one magnet 70 configured to generate a magnetic field to alter a flow of water through the trapway 60. In this embodiment, the at least one magnet includes a plurality of permanent magnets 70 arranged radially around the trapway 60 or along the length of the trapway 60. In this embodiment, magnet 70 is a bar magnet which is at least one magnet. The magnetic field generated by the magnet 70 may be configured to directly alter the flow of water through the trap passageway 61. In some embodiments, the liquid flowing through the trap passageway 61 may be a diamagnetic liquid, such as water, or another substance substantially made up of water such as urine. The term substantially made up of water may mean more than 50%, or otherwise a majority, of water by volume. In the case of a diamagnetic liquid, the magnetic field may repel the liquid based on natural properties of the diamagnetic liquid that cause the diamagnetic liquid to be repelled by all magnetic fields (both north and south poles). In other embodiments, the liquid may have a particular charge based on the ions in the liquid or the polarity of the molecules comprising the liquid. For example, water may have a partial positive charge based on the hydrogen atoms and/or a partial negative charge based on the oxygen atom. In some embodiments, the liquid, such as water, may be repelled and/or attracted based on the charge (partial or otherwise) of the liquid and or the orientation of the one or more magnetic fields.

As the liquid (e.g., water, urine) passes or flows through the trap passageway 61 the magnetic field causes a force to be applied to the liquid. The liquid may flow through the trap passageway, for example, during a flush cycle of the toilet. In some embodiments, in the case of a diamagnetic liquids, the magnetic field causes the flow of liquid to be repelled or repulsed out of the magnetic field. In other embodiments, the magnetic field may repel or attract the liquid based on the charge of the liquid. The magnetic field may have a predetermined strength corresponding to a desired magnitude of force to be applied to the liquid. The at least one magnet 70, and thus the corresponding magnetic field, may be positioned so that the force applied to the liquid is in a desired direction. Accordingly, the force may be applied at a predetermined angle or angles. The force applied by the magnetic field may assist the flow of liquid through the trap passageway 61 during a flush cycle of the toilet. That is, the magnetic field may be configured to assist a flow of water through the trapway 60 during the flush cycle. In some embodiments, a flush cycle may include a siphon and the force may be applied in a direction or directions to assist the siphon. The repulsive force may otherwise assist the flush action and prevent clogs from occurring during the flush cycle.

The one or more magnets 70 in this embodiment may be arranged at various locations (e.g., radially around the passage, along the length of the passage) relative to the passageway 61 to a achieve a magnetic field, and thus a force, or forces in predetermined directions. The magnet 70 may be fixed to the pedestal 21 of the toilet proximate to the trapway 60. In some embodiments, the one or more magnets may be arranged to have their north (i.e., positive) poles more near the trap passageway 61 than their south (i.e., negative) poles, their south poles more near the trap passageway 61 than their north poles, or a combination thereof to achieve a force or forces in predetermined directions. In other embodiments, for example, in the case of diamagnetic liquids, the orientation of a magnetic pole relative to the trap passageway may affect the magnitude and/or direction of the force; however, it may not matter whether the pole is a north or south pole. The orientation, size, and shape of the one or more magnets may vary. FIG. 3 illustrates an embodiment in which the one or more magnets 70 are permanent magnets and are rectangular and disposed adjacent to the trap passageway.

Figure 4:
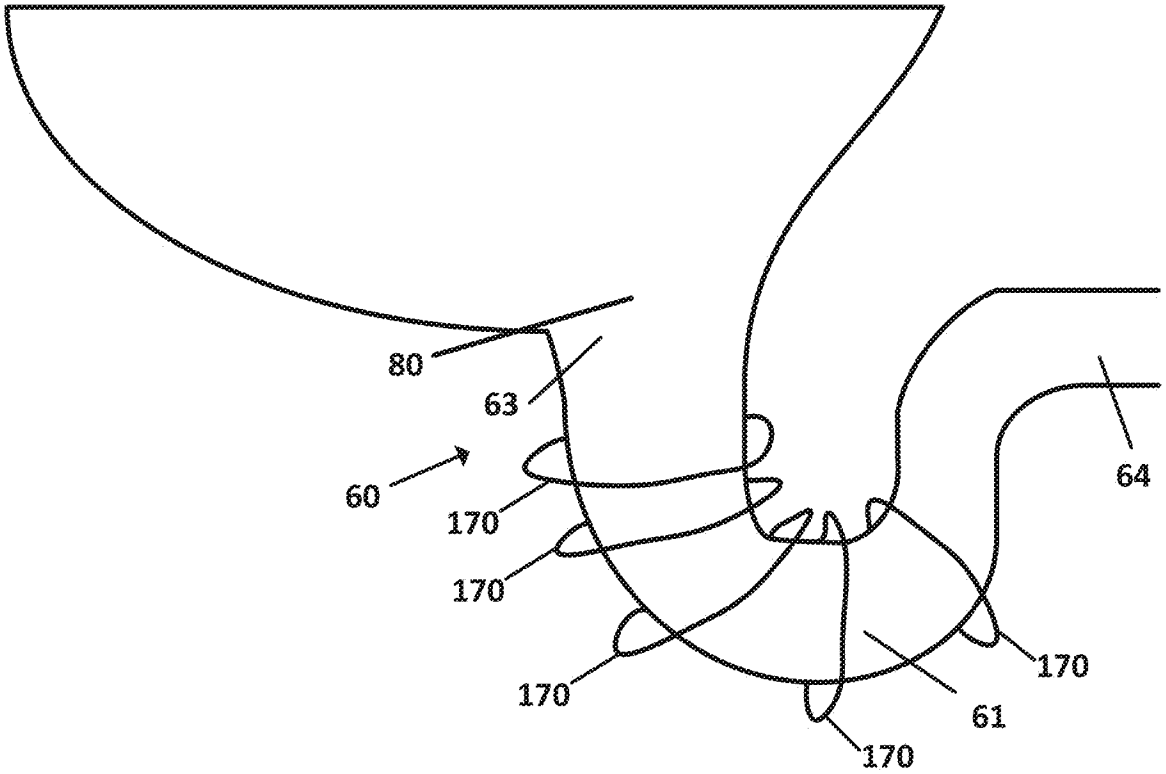
FIG. 4 is a sideview of a trapway according to an exemplary embodiment of the present disclosure.

FIG. 4 illustrates a trapway 60 according to another exemplary embodiment of the present disclosure. The embodiment as illustrated in FIG. 4 includes one or more ring magnets 170, which is at least one magnet. In this embodiment, the one or more ring magnets 170 circumscribe the trap passageway 61. In some embodiments, the ring magnets 170 may be fixed to the trapway 60 of the toilet (e.g., toilet 10 or 20). In some embodiments, the ring magnets 170 may be fixed to a pedestal of the toilet. In some embodiments, the one or more magnets 170 may be integrally formed with the toilet and/or one or more components of the toilet. For example, the toilet or one or more components of the toilet may be formed (e.g., cast, molded, etc.) around the one or more magnets. For example, the trapway may be molded around the one or more magnets 170. In other embodiments, the magnets 170 may be attached to one another and fixed to the toilet (e.g., the trapway 60) after toilet has been formed.

In some embodiments, the ring magnets 170 may be positioned such that a north pole of the magnets is disposed on an interior surface of the magnet 170 closest to the trapway 60. In other embodiments, the ring magnets 170 may be positioned such that a south pole of the magnets is disposed on an interior surface of the magnet 170 closest to the trapway 60. In other embodiments, the ring magnets 170 may be positioned such that a north pole is disposed on a side of the magnet 170 so as to face a downstream direction of a flow of liquid through the trapway 60 during a flush cycle. In other embodiments, the ring magnets 170 may be positioned such that a south pole is disposed on a side of the magnet 170 so as to face a downstream direction of a flow of liquid through the trapway 60 during a flush cycle.

In some embodiments, the ring magnet 170 may be configured to apply a force (e.g., a repulsive force, an attractive force) on a liquid flowing through the trap passageway 61 towards the center of the trap passageway 61. Applying a force on the liquid towards the center of the trap passageway 61 may reduce friction forces occurring on the walls of the trap passageway as the liquid flows through the trap passageway 61, increasing flush power during a flush cycle.

It should be noted that the various shapes and configurations of the trapway 60 may vary. In one example, FIGS. 3 and 4 illustrate embodiments of the present disclosure in which the trapway 60 is a p-trap. A p-trap is a trapway including a horizontal outflow arm of the trapway, for example trapway 60. An s-trap is a trapway having a vertical outflow of arm of the trapway, for example trapway 160 illustrated in FIGS. 5 and 6. In some applications, in consideration of local building codes, an embodiment of the present disclosure including a p-trap (trapway 60) may be required. A p-trap may be used in applications where a toilet (e.g., toilet 10 or 20) is connected to a drainpipe located in a wall. The horizontal outlet of a p-trap may make it more suitable for application in which a drain pipe is located in a wall or in which it is not possible or convenient to install a drainpipe in a floor (e.g., in the case of a concrete floor). An s-trap may be used in applications where allowed by building regulation and where a drain pipe is located in the in a floor and/or it is not possible or convenient to install a drainpipe in a wall. Generally, p-traps are preferred for their superior performance in preventing sewer gases from traversing through a drainpipe.

Figure 5:
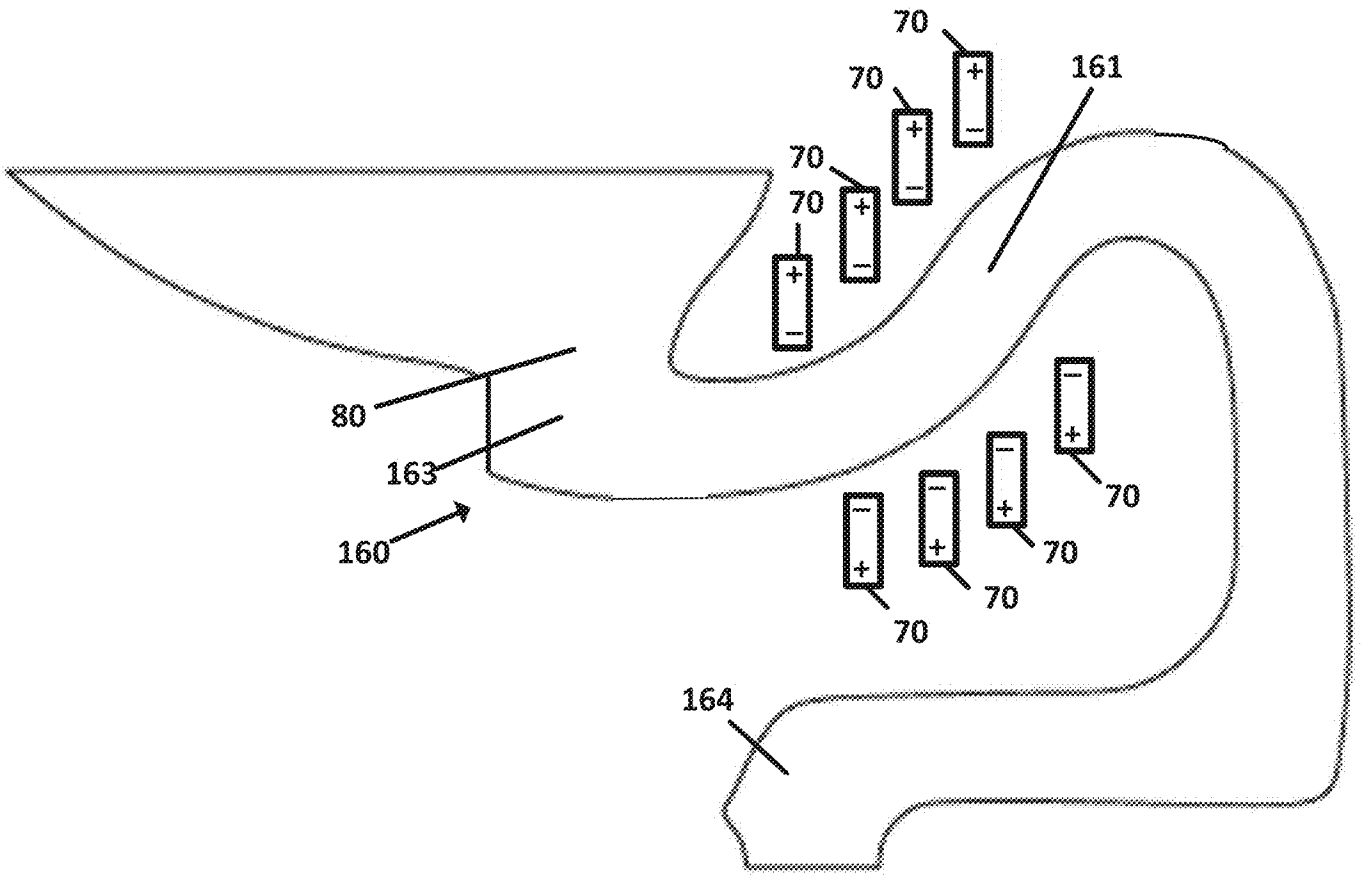
FIG. 5 is sideview of a trapway according to an exemplary embodiment of the present disclosure.
Figure 6:
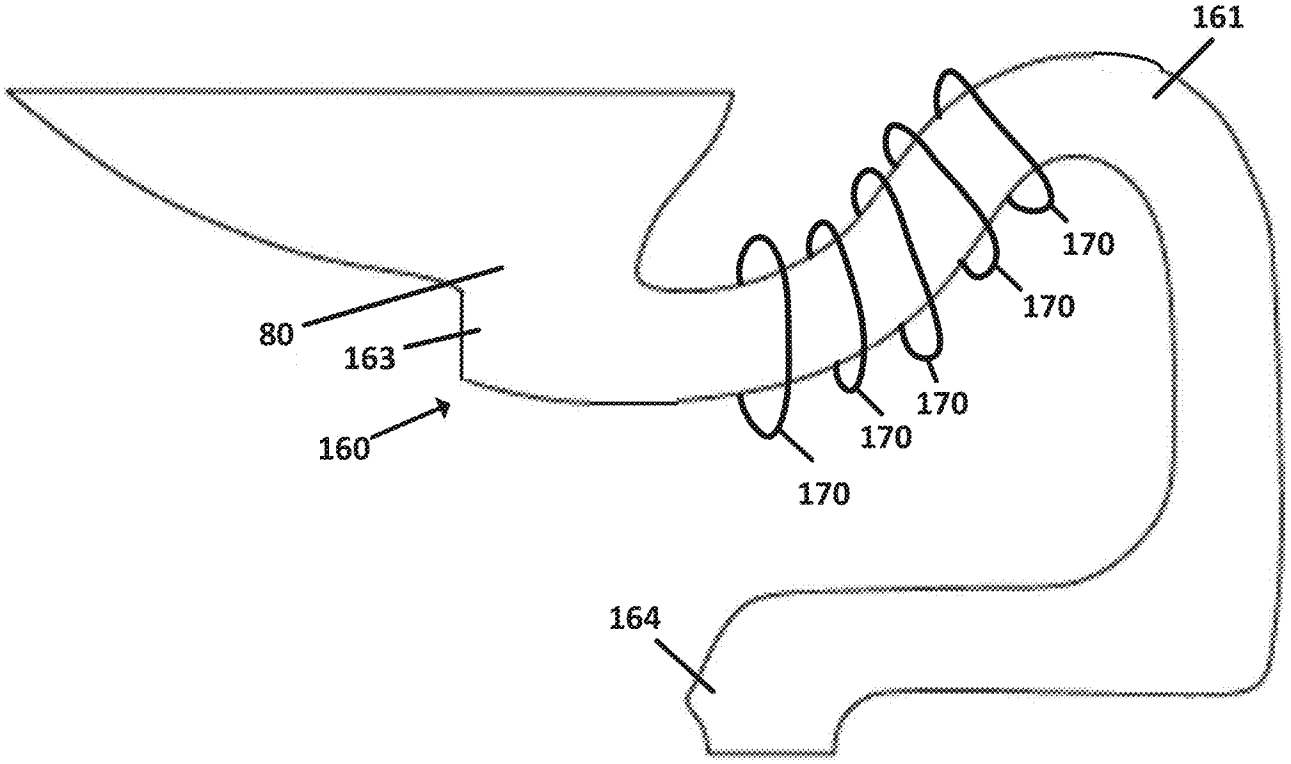
FIG. 6 is sideview of a trapway according to an exemplary embodiment of the present disclosure.

FIGS. 5 and 6 illustrate the embodiments of FIGS. 3 and 4, respectively, applied to a trapway having an s-shape. Other shapes are possible. The trapway 160 as illustrated in FIGS. 5 and 6 includes trap passageway 161 extending from a first end 163 to a second end 164. The trapway 160 including first end 163, second end 164, and trap passageway 161 may be the same as the trapway 60 of FIGS. 3 and 4, and its respective constituent components, with the exception that trapway 60 has a p shape and trapway 160 has an s shape.

Figure 7:
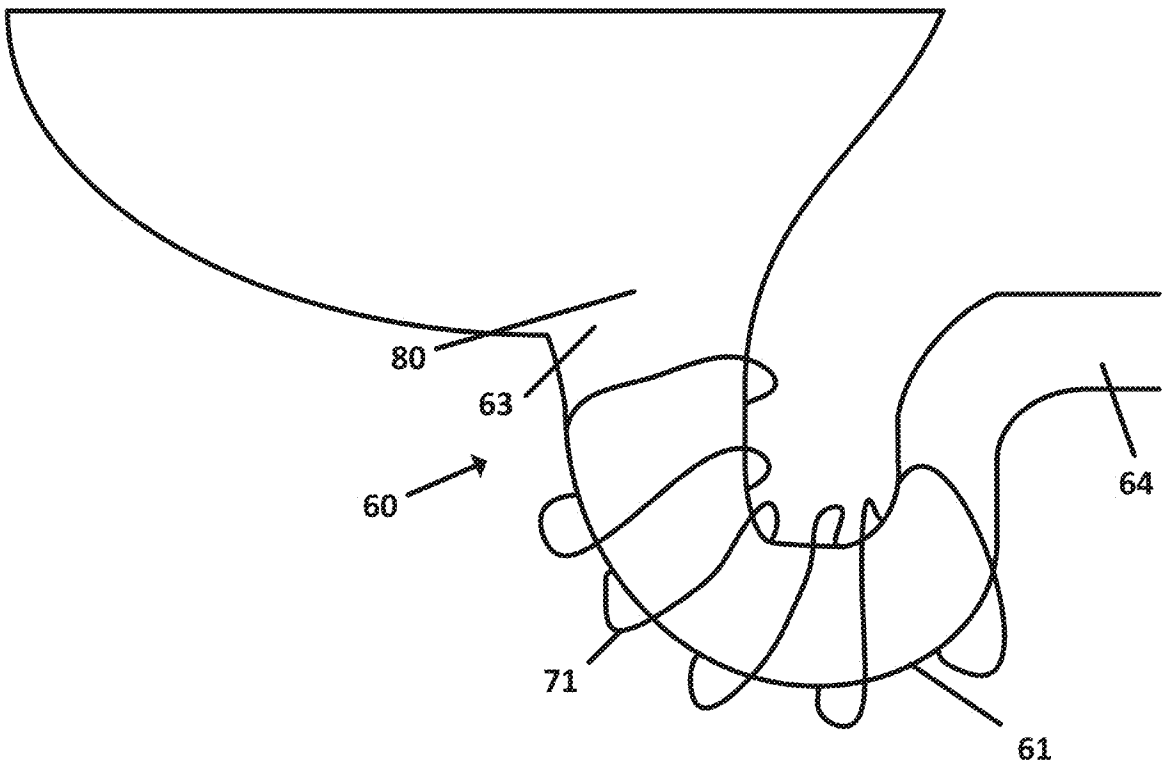
FIG. 7 is sideview of a trapway according to an exemplary embodiment of the present disclosure.

FIG. 7 illustrates a sideview of a trapway 60 according to another embodiment of the present disclosure. As illustrated in the embodiment of FIG. 5, the trapway 60 includes trap passageway 61 extending from first end 63 to second end 64. In this embodiment, the trapway includes one or more magnets comprising one or more electromagnets or electromagnetic coils 71. The trap passageway 61, first end 63, and second end 64 may be the same as discussed above with respect to FIGS. 3 and 4 discussed above. The one or more magnetic coils 71 may be configured to produce one or more magnetic fields. The magnetic fields generated by the magnetic coils 71 may alter the flow of a liquid through a toilet as described above with respect to the magnets 70 of FIG. 3.

The electromagnetic coils 71 like the magnets 70 of FIG. 3 may be arranged at various locations (e.g., radially around the passage, along the length of the passage) relative to the trap passageway 61 to generate a magnetic field, and thus a force or forces in a predetermined direction. In some embodiments, and as illustrated in FIG. 5, the one or more electromagnetic coils 71 may be wrapped around (e.g., circumscribe) the trap passageway 61. An electromagnetic coil 71 circumscribing the trap passageway 61 may begin at the first end 63 of the trap passageway 61 and end at the second end 64 of the trap passageway 61. One or more electromagnetic coils 71 may circumscribe some portions of the trap passageway 61 and not other portions of the trap passageway 61. In other embodiments, the one or more electromagnetic coils 71 may not circumscribe the trap passageway 61 and may be located proximate and/or adjacent to the trap passageway 61.

The one or more electromagnetic coils 71 may selectively generate a magnetic field. The electromagnetic coil 71 may generate a magnetic field when an electric current is flowing through the electromagnetic coil 71. Accordingly, generation of the magnetic field can be controlled by supplying and/or cutting off the supply of current to the electromagnetic coil 71.

The one or more electromagnetic coils 71 are connected to a power source. In one example the power source may be a battery or battery pack. In another example, the power source may be a building power supply, such as a wall outlet. In some embodiments, the one or more electromagnetic coils 71 may be connected to a wall outlet via a transformer and a wall plug.

In some embodiments, the supply of current to the one or more electromagnetic coils 71 may be controlled by a switch. Accordingly, when the switch is in a first position an electrical current may be supplied (i.e., flow) to the electromagnetic coil 71 and the electromagnetic coil 71 may produce a magnetic field. Conversely, when the switch is in a second position an electric current may not flow through the electromagnetic coil 71 and a magnetic field may not be produced. In some embodiments, a user may operate the switch manually, for example, by pressing a button or moving a physical switch. In other embodiments, the switch may be operated automatically (e.g., by a controller) in response to sensor data or a flush cycle. In some embodiments, the trapway 60 and thus toilet, may further include a sensor. The sensor may be configured to produce sensor data indicative of a presence of a user, a water level in the bowl of the toilet, and/or a blockage in the trapway. An exemplary embodiment of a controller that may be used to operate a switch for controlling a flow of current to one or more electromagnetic coils is described below.

Figure 8:
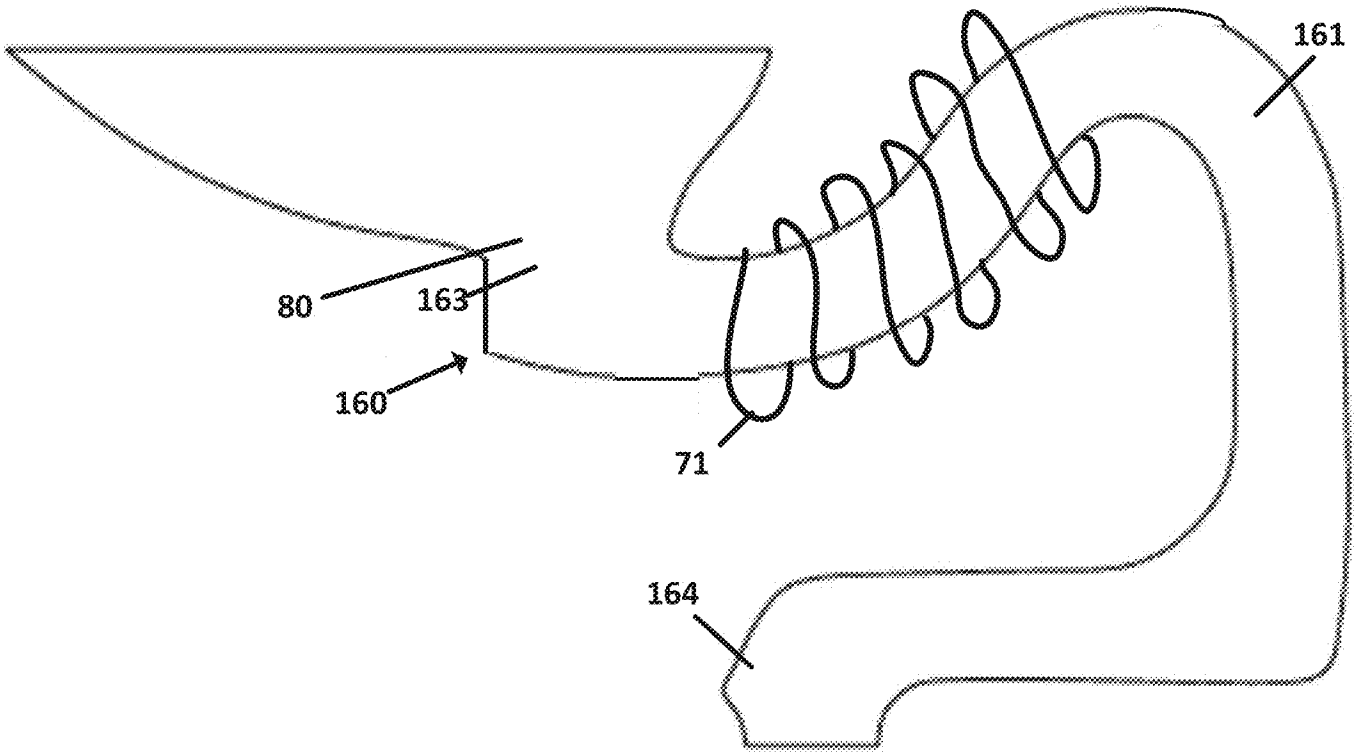
FIG. 8 is sideview of a trapway according to an exemplary embodiment of the present disclosure.

It should be noted that the various shapes and configurations of the trapway 60 may vary. FIG. 7 illustrates an embodiment of the present disclosure in which trapway 60 is a p-trap. However, the trapway 60 may be any shape. For example, FIG. 8 illustrates a trapway 160 having an s-shape. The trapway 160 illustrated in FIG. 8 may be the same trapway as discussed above with respect to FIGS. 5 and 6. Trapway 160 may have an outlet arm of the trapway (i.e., second end 164) disposed in the vertical direction making it suitable to connect with a drainpipe disposed below the toilet.

Figure 9:
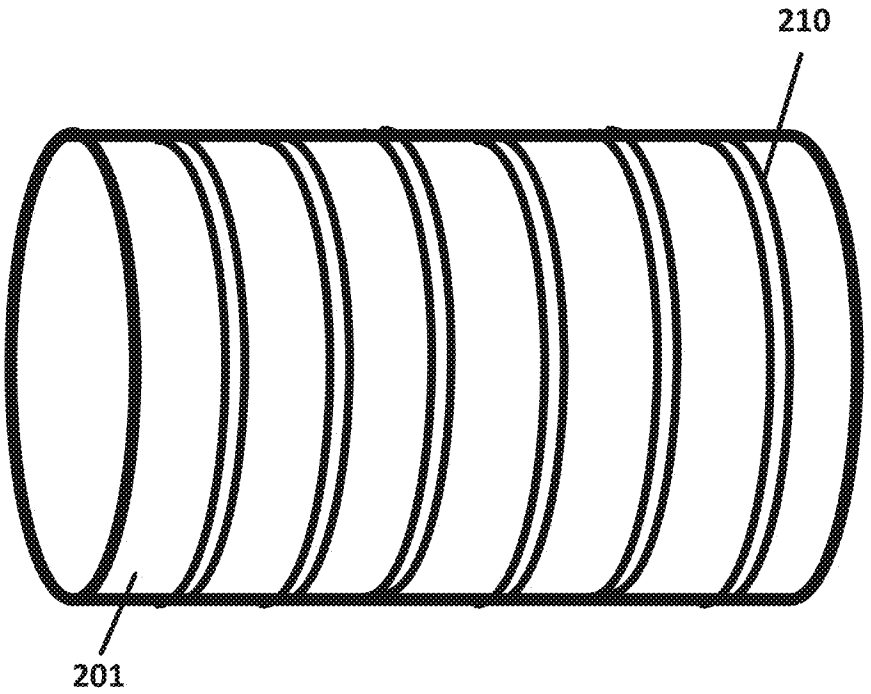
FIG. 9 is a side perspective view of an apparatus for generation and application of a magnetic field in a toilet according to an exemplary embodiment of the present disclosure.

FIG. 9 illustrates an apparatus for generating and applying a magnetic field in a toilet according to an exemplary embodiment of the present disclosure. The apparatus as shown in this embodiment includes a flexible sleeve 201 and one or more magnets 210 secured to the flexible sleeve 201. In this embodiment, the one or more magnets 210 are a series of permanent magnets. In some embodiments, and as illustrated in FIG. 9, the one or more magnets 210 may be circular (e.g., ring) magnets. In other embodiments, the one or more magnets may be rectangular magnets. The shape of the one or more magnets 210 may vary and any suitable shape may be used. The one or more magnets 210 may be secured to the flexible sleeve 201 at various locations (e.g., radially around the sleeve, along the length of the sleeve). In some embodiments, the flexible sleeve 201 may include one or more openings or pockets in which the one or more magnets are secured.

The flexible sleeve 201 is configured to deform (e.g., flex) to be inserted into the trapway of a toilet. The flexible sleeve 201 may be inserted into the trapway of a toilet, even after installation of a toilet. When inserted into the trapway of a toilet, the flexible sleeve is configured to line a trap passageway. The material comprising the flexible sleeve 201 may be selected based on its physical properties. For example, the material may be selected based on its durometer. The flexible sleeve 201 may be comprised of a rubber or a rubber like resin.

The one or more magnets 210 are configured to generate one or more magnetic fields. When the flexible sleeve 201 and the one or more magnets 210 are inserted in the trapway of a toilet, the magnetic fields may be configured to alter a flow of liquid through the trapway. The magnetic fields generated by the one or more magnets 210 may alter a flow of liquid through the trapway as described above with respect to the magnets 70 of FIG. 3.

The one or more magnets 210 like the magnets 70 of FIG. 3 may be arranged at various locations (e.g., radially around, along the length of) relative to the flexible sleeve 201 and thus the trapway, to achieve a force or forces in a predetermined direction.

Figure 10:
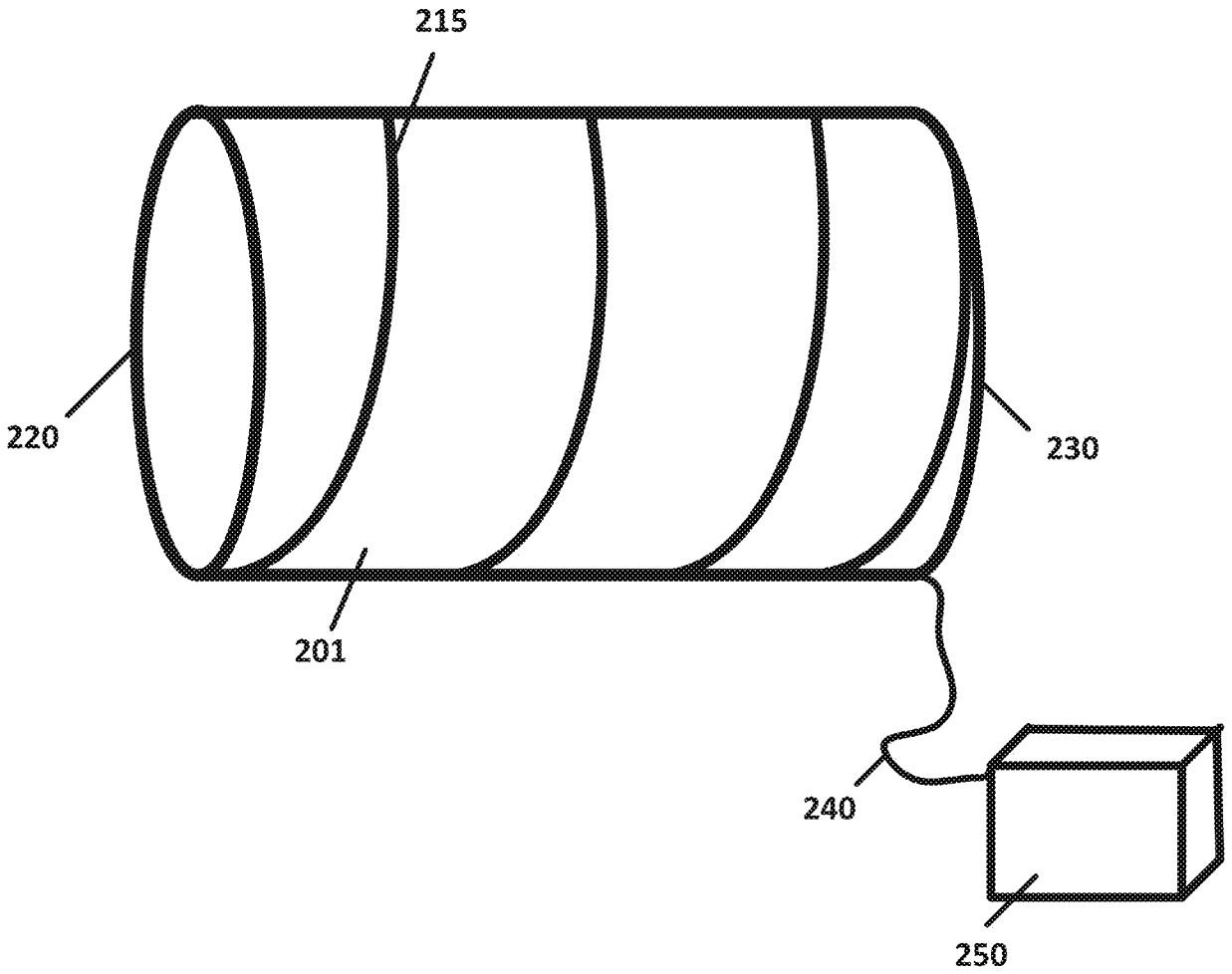
FIG. 10 is side perspective view of an apparatus for generation and application of a magnetic field according to an exemplary embodiment of the present disclosure.

FIG. 10 illustrates an apparatus for generating and applying a magnetic field in a toilet according to another exemplary embodiment of the present disclosure. The apparatus shown in this embodiment include a flexible sleeve 201, one or more magnets comprising one or more electromagnetic coils 215, an apparatus housing 250, and cord 240. The flexible sleeve 201 may be the same as described above with respect to the embodiment of FIG. 9. The one or more electromagnetic coils 215 may be configured to produce one or more magnetic fields. The one or more magnetic fields may alter a flow of water through a trapway as described above with respect to the one or more magnets 210 of FIG. 9.

The electromagnetic coils 215 may be arranged at various locations (e.g., radially around, along the length) relative to the flexible sleeve 201 to generate a magnetic field, and thus a force or forces in a predetermined direction. In some embodiments, and as illustrated in FIG. 10, the one or more electromagnetic coils 215 may be wrapped around (e.g., circumscribe) the flexible sleeve 201. An electromagnetic coil 71 circumscribing the flexible sleeve 201 may begin at a first end 220 of the flexible sleeve 201 and extend to a second end 230 of the flexible sleeve. One or more electromagnetic coils 215 may circumscribe some portions of the flexible sleeve 201 and not other portions of the flexible sleeve 201. In other embodiments, the one or more electromagnetic coils 215 may not circumscribe the flexible sleeve 201 and may be secured to the flexible sleeve 201 adjacent to the flexible sleeve 201.

The one or more electromagnetic coils 215 may selectively generate a magnetic field. The electromagnetic coils 215 may generate a magnetic field when an electric current is flowing through the electromagnetic coil 215. Accordingly, generation of the magnetic field can be controlled by supplying and/or cutting off the supply of current to the electromagnetic coil 215.

Figure 14:
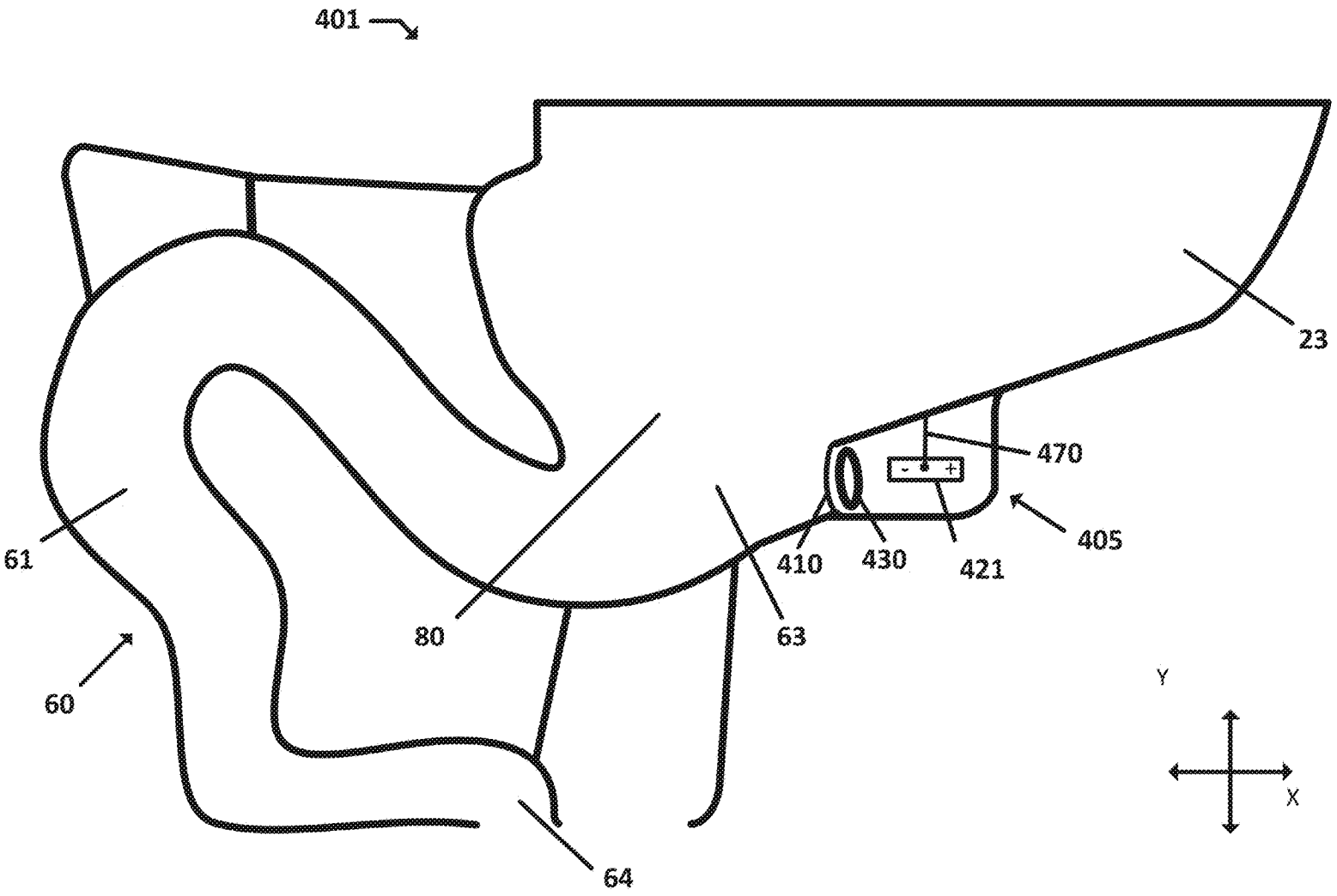
FIG. 14 is sideview of a toilet according to an exemplary embodiment of the present disclosure.

The one or more electromagnetic coils 215 are connected to the housing 250 via a cord 240. The housing is configured to hold one or more batteries to selectively supply a current to the one or more electromagnetic coils 215. In some embodiments, the housing 250 may include a transformer for reducing or increasing the voltage of the electric current supplied to the one or more electromagnetic coils 215. In some embodiments, the housing 250 may include a switch for selectively allowing current to flow to the one or more electromagnetic coils 215. In some embodiments, the housing 250 may include a controller for activating/deactivating the one or more electromagnetic coils 215 (e.g., for operating a switch). The housing 250 may further comprise a sensor in communication with the controller configured to collect sensor data. The controller may be configured to activate/deactivate the electromagnet in response to the sensor data received from the sensor. FIG. 14, described hereinafter, illustrates an exemplary embodiment of a controller that may be used to operate a switch for controlling a flow of current to one or more electromagnetic coils.

When the flexible sleeve 201 is installed in the trapway of a toilet, when liquid flows through the flexible sleeve, and thus the trapway, the one or more electromagnetic coils may be activated (e.g., supplied with electric current) to generate one or more magnetic fields. The one or more magnetic fields may apply a force or forces to a flow of liquid through the trapway, altering the flow of liquid through the trapway. The force may be of a predetermined magnitude based on the electromagnetic coil 215 and the current (e.g., voltage of the current) supplied to the electromagnetic coil 215. The force may be at a predetermined angle or multiple predetermined angles. The force may be in a direction to assist the siphon of the flush cycle. The force may be in a direction to assist the flush cycle and help to prevent clogs in the trapway.

Figure 11:
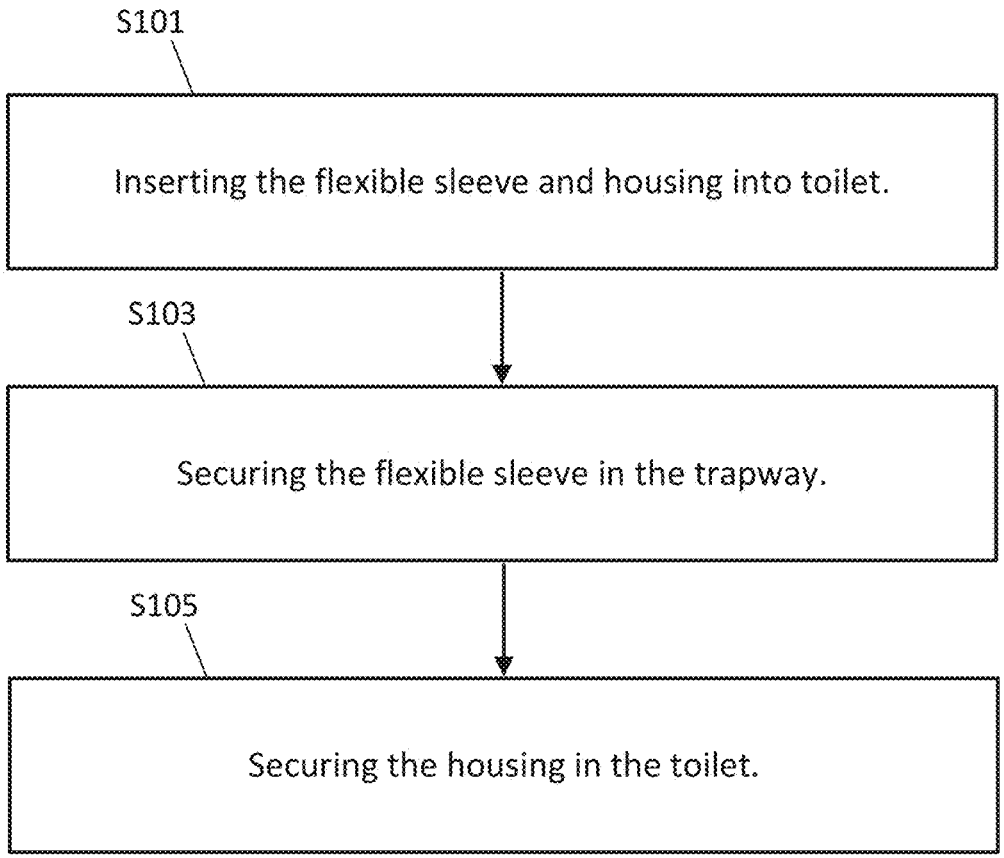
FIG. 11 illustrates a flow chart for a method of installing an apparatus for generation and application of a magnetic field in a toilet according to an exemplary embodiment of the present disclosure

FIG. 11 illustrates a flowchart for a method of installing an apparatus for generating and applying a magnetic field in a toilet according to an exemplary embodiment of the present disclosure. The various devices and systems disclosed herein, for example the devices of FIGS. 9 and 10, may be installed using the method of FIG. 11. Additional, fewer, or different acts may be included.

At act S101, the flexible sleeve (e.g., flexible sleeve 201) and the housing (e.g., housing 250) are inserted into the toilet (e.g., toilet 10, 20). In some embodiments, the flexible sleeve and the housing may be configured to be inserted into the toilet when a liquid, such as water, is present in the trapway. In other embodiments, the flexible sleeve and housing may be configured to be inserted into the trapway when there is not a liquid in the trapway.

In some embodiments, the flexible sleeve 201 may be deformed to fit into the toilet. For example, the flexible sleeve may be compressed radially in word to fit into the trapway 60. One or more magnets (e.g., magnets 210, coils 215) may be secure to the flexible sleeve such that they may change positions as the flexible sleeve deforms. The flexible sleeve may be inserted into the trapway of the toilet and the housing may be inserted into the bowl or the trapway of the toilet.

At act S103, the flexible sleeve is secured to the trapway of the toilet. In embodiments where the flexible sleeve is compressed radially to be inserted into the trapway, a radially outward force exerted by the flexible sleeve on the surface of the trap passageway (e.g., trap passageway 61, 161) caused by the flexible sleeve's natural tendency to return to its original shape may secure the flexible sleeve within the trapway. In some embodiments, the flexible sleeve may be comprised, at least in part, of hydromorphic polymer that expands in water. In embodiments, where the flexible sleeve is comprised of hydromorphic polymer, as the sleeve expands it may exert a radially outward force on the interior surface of the trap passageway, securing the flexible sleeve within the trap passageway. In other embodiments, an adhesive may be used to secure the flexible sleeve within the trapway. Other means of securing the flexible sleeve to the trapway may be used.

At act S105, the housing is secured to the toilet. In some embodiments, the housing may be secured to the sleeve. In these embodiments, the housing may be secured within a trapway of the toilet in the same manner that the flexible sleeve is secured to the trapway (e.g., radially outward force). In some embodiments, the housing may be secured to within the trapway of the toilet. For example, the housing may be installed in the trapway when the housing includes a sensor for sensing a clog in the trapway. In other embodiments, the housing may be secure within the bowl of the toilet. The housing may be secured within the bowl of the toilet when the housing includes, for example, a sensor for detection a water level in the bowl or a sensor for detecting the presence of a user. In one embodiment, the housing may be secured to the housing using an adhesive. Other means of securing the housing to the toilet may be used.

Figure 12:
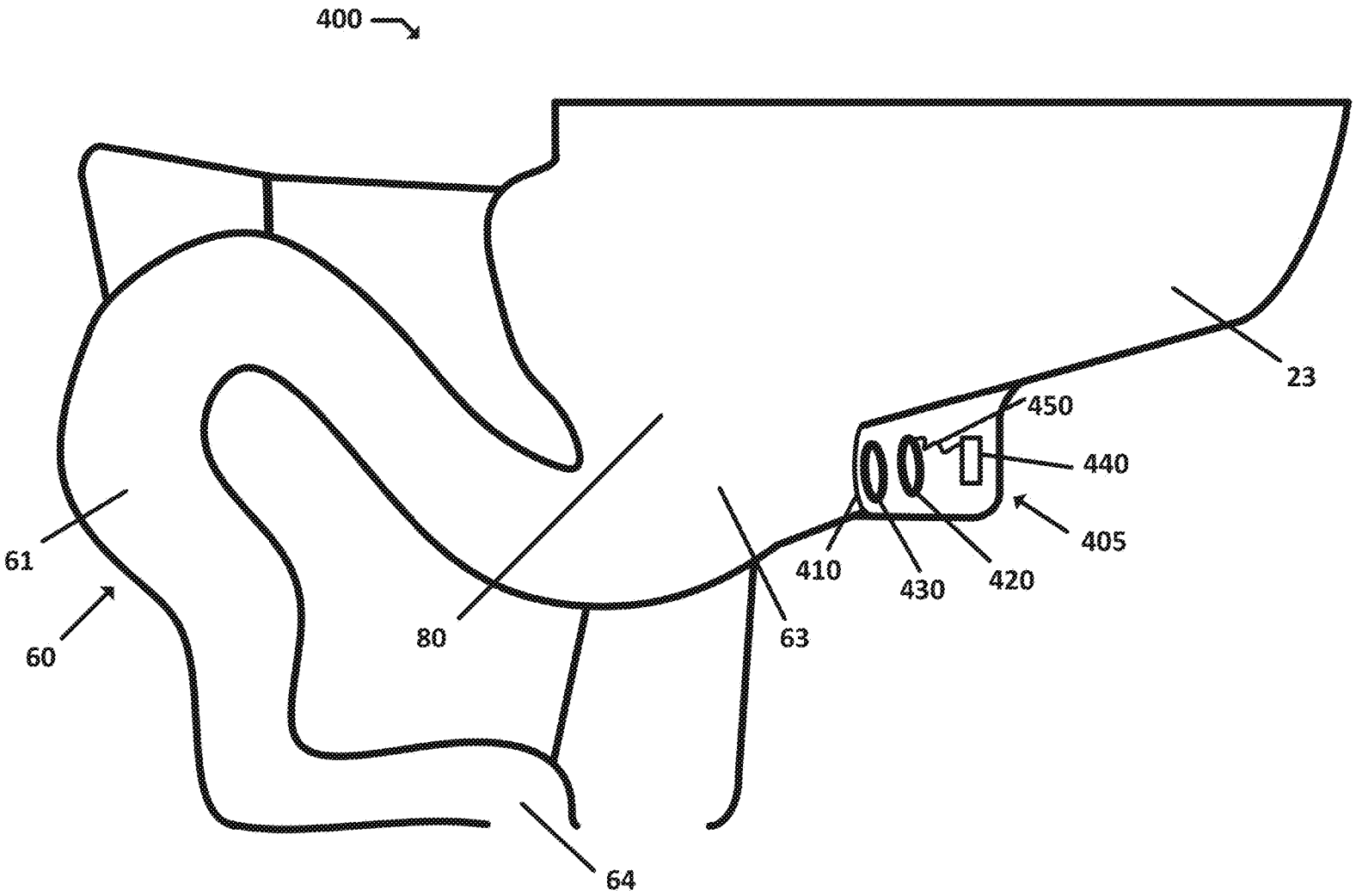
FIG. 12 is sideview of a toilet according to an exemplary embodiment of the present disclosure.

FIG. 12 illustrates a sideview of a toilet 400 according to an exemplary embodiment of the present disclosure. The toilet 400 includes a bowl 23 and trapway 60. The trapway includes trap passageway 61 extending from a first end 63 to a second end 64. The first end 63 of the trap passageway 61 is connected (e.g., fluidly, structurally) to a discharge outlet 80 of the bowl 23. The bowl 23 may be the same as described above with respect to FIG. 1 and the trapway 60 may be the same as described above with respect to FIG. 3. The toilet 400 further includes a flexible membrane 410 and a housing 405 including a driving magnet 420, a driven magnet 430, a power source 440, and a cable 450.

The flexible membrane 410 may be disposed in the trapway 60 and may form a portion of the interior surface of the trap passageway 61. The flexible membrane 410 may be configured to elastically deform. The flexible membrane 410 may be configured to elastically deform, extending into the trap passageway 61. The material comprising the flexible membrane 410 may be selected based on its physical properties. For example, the material may be selected based on its durometer. The flexible membrane 410 may be comprised of a rubber or a rubber like resin.

The housing 405 includes the driving magnet 420, a driven magnet 430, a power source 440, and a cable 450. The housing 405 may be disposed below the bowl 23 adjacent to the trapway 60. The housing 405 may be disposed on a front end of the toilet 400. In some embodiments, the housing 405 may be comprised of vitreous china. In other embodiments, the housing 405 may be comprised of a polymeric material and/or over molded or otherwise fixed to the toilet 400. In some embodiments, the housing 405 may be integrally formed with the bowl 23 and/or trapway 60 of the toilet 400 as a one-piece design. In other embodiments, the housing 405 may be formed separately from the bowl 23 and/or the trapway 60 of the toilet as a two- or three-piece design.

Figure 15:
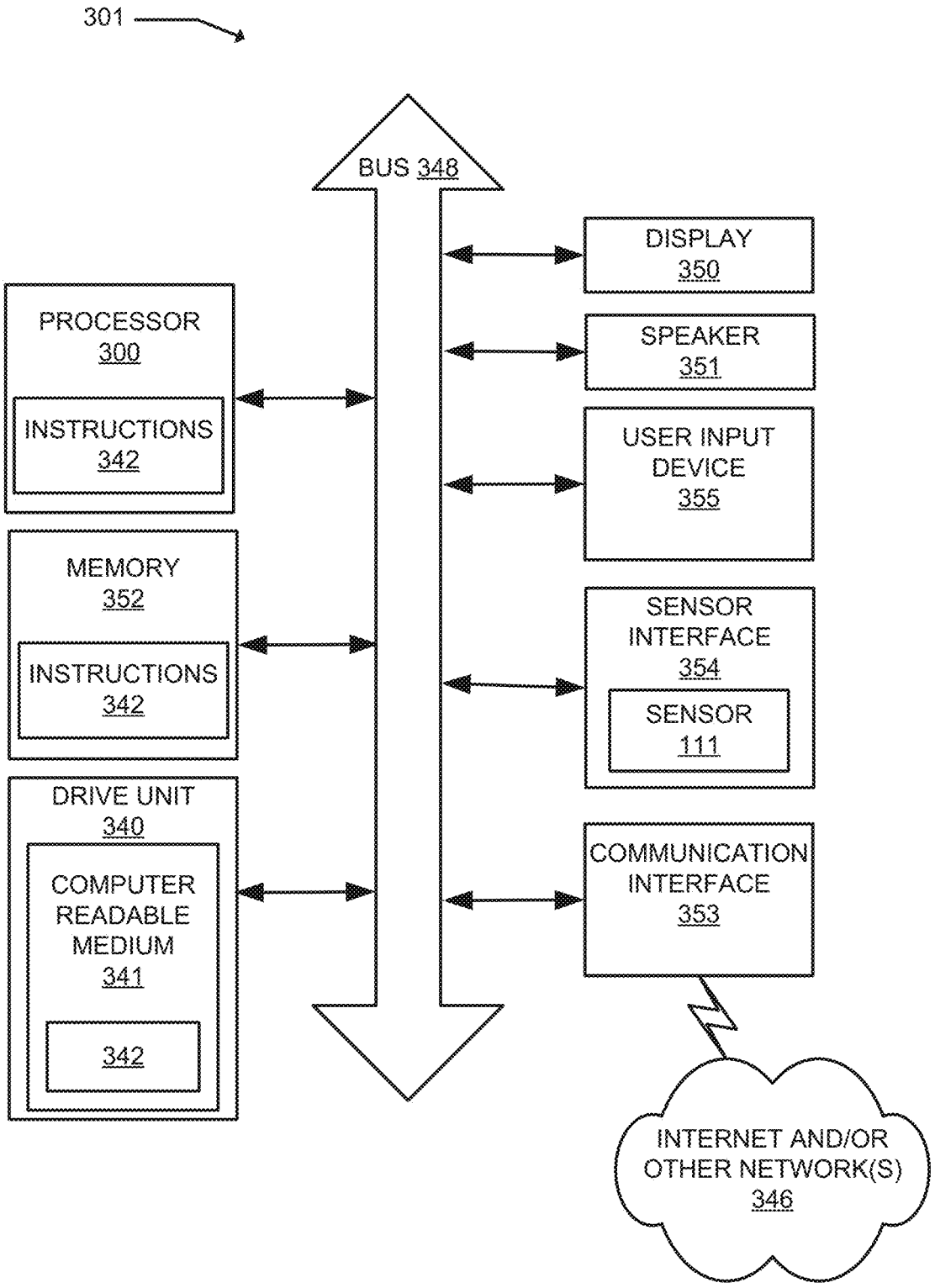
FIG. 15 illustrates a controller for a magnetic field according to an exemplary embodiment of the present disclosure.

The driving magnet 420 may be located in the housing 405 and may comprise an electromagnetic coil. The driving magnet 420 may be connected to the power source 440 via cable 450. The driving magnet 420 may be configured to selectively generate a magnetic field. The driving magnet 420 may generate a magnetic field when a current is flowing through the electromagnetic coil. In some embodiments, a supply of current to the driving magnet 420 may be controlled by a switch. When the switch is in a first position, electric current may flow to the driving magnet, causing the driving magnet 420 to generate a magnetic field. When the switch is in a second position, the electric current may not flow to the driving magnet 420 and the driving magnet 420 may not generate a magnetic field. In some embodiments, a user may operate the switch manually. In other embodiments, the switch may be operated automatically, for example by a controller. FIG. 15 described hereinafter illustrates an exemplary embodiment of a controller that may be used to operate a switch for controlling a flow of current to the driving magnet 420.

The driven magnet 430 may be located in the housing 405 and is coupled to the flexible membrane 410. The driven magnet 430 may be directly or indirectly coupled to the flexible membrane (i.e., another component may be disposed between the driven magnet 430 and the flexible membrane 410). In some embodiments, the driven magnet may be a permanent magnet such as a circular or rectangular permanent magnet. In other embodiments, the driven magnet 430 may be an electromagnet (i.e., comprise an electromagnetic coil connected to a power source). The driven magnet 430 may be located more proximate to the trapway 60 than the driving magnet 420.

In some embodiments, and as illustrated in FIG. 12, the power source 440 may be a battery or battery pack. However, in other embodiments, the power source may be building power source and the driving magnet may be connected to the building power source via a transformed and/or a wall outlet.

In this embodiment, the driving magnet 420 is configured to selectively generate a magnetic field. When the driving magnet 420 generates a magnetic field, the driven magnet 430 is repelled away from the driving magnet 420 causing the driven magnet 430 to move away from the driving magnet 430. As the driven magnet 430 moves away from the driving magnet 420, it causes the flexible membrane 410 to deform and extend into the trap passageway 61. As the flexible membrane 410 deforms and extends into the trap passageway 61, the flexible membrane 410 exerts a force on the liquid within the trap passageway 61.

The generation of a magnetic field by the driving magnet 420 can be timed to coincide with a flush cycle of the toilet 400, such that generation of the magnetic field and the subsequent deformation of the flexible membrane 410 exerts a force on the liquid flowing through the trapway during the flush cycle of the toilet 400, altering the flow of water through the trap passageway 61. In some embodiments, the driving magnet may generate a magnetic field just before a flush cycle begins. In other embodiments, the driving magnet 420 may generate a magnetic field during a flush cycle. The driving magnet 420 may generate a magnetic field at any point during the flush cycle, for example, at the beginning, the middle, or the end of the flush cycle. In some embodiments, the driving magnet 420 may generate a magnetic field two or more times during a flush cycle. For example, the driving magnet 420 may generate a magnetic field at the beginning of a flush cycle, cease generating a magnetic field, and then generate a magnetic field again at the end of the flush cycle. Accordingly, the flexible membrane 410 may be moved into the trap passageway 61 two times, altering the flow of water through the trapway both at the beginning and the end of the flush cycle. In other embodiments, the driving magnet 420 may generate a magnetic field after a flush cycle.

The driven magnet 430 and the flexible membrane 410 may return to their original positions when the driving magnet 420 stops generating a magnetic field. In some embodiments, the flexible membrane 410 may elastically deform and the driven magnet 430 and the flexible membrane 410 may return to their original position due to the flexible membranes 410 natural tendency to return to its original shape. In other embodiments, toilet 400 may include an elastic member configured to return the flexible membrane 410 and the driven magnet 430 to their original position.

In some embodiments, a controller may be used to control a supply of electric current to the driving magnet 420. Described hereinafter is a controller that may be used to control driving magnet 420.

FIG. 12 illustrates a sideview of the toilet 400 in a first position according to an exemplary embodiment of the present disclosure. As illustrated in FIG. 12, the driving magnet 420 is not generating a magnetic field (i.e., current is not flowing to through the driving magnet). Accordingly, the flexible membrane 410 and the driven magnet 430 are in a first position (i.e., original position).

Figure 13:
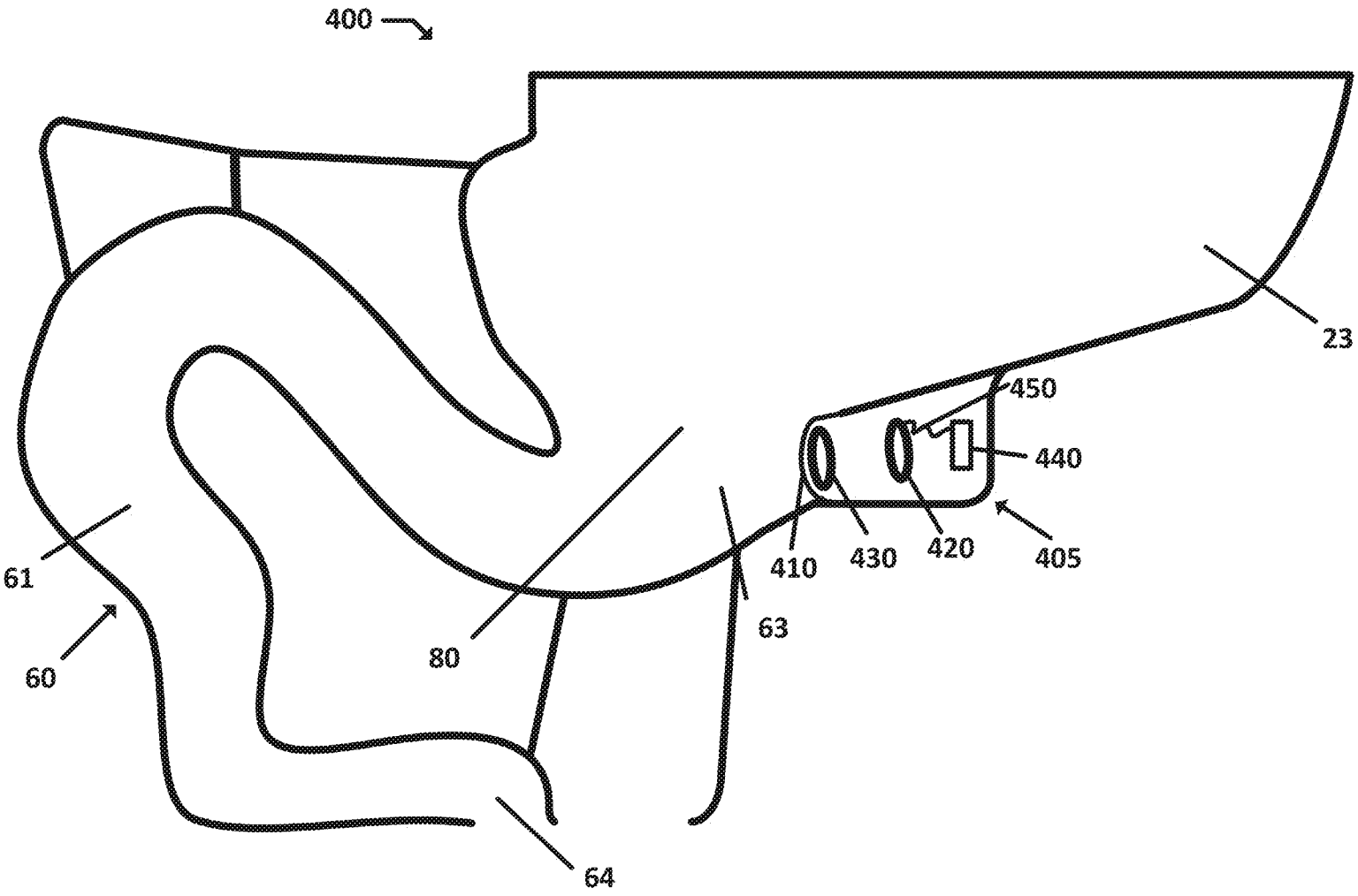
FIG. 13 is sideview of a toilet according to an exemplary embodiment of the present disclosure.

FIG. 13 illustrates a sideview of the toilet 400 as illustrated in FIG. 11 in a second position according to an exemplary embodiment of the present disclosure. In the toilet as illustrated in FIG. 13 the driving magnet 420 is generating a magnetic field (i.e., current is flowing through the driving magnet). Accordingly, the driven magnet 430 is repelled by the driving magnet 420, causing the driven magnet 430 and the flexible membrane to move to second positions, respectively, as illustrated in FIG. 13. The flexible membrane 410, in its second position, is deformed and extends into the trap passageway 61. The driven magnet 430, in its second position, is located further away from the driving magnet 420 than in its first (i.e., original) position. In some embodiments, the driven magnet 430 may extend into the trap passageway 61.

FIG. 14 illustrates a toilet 401 according to another embodiment of the present disclosure. The toilet 401 includes a bowl 23 and trapway 60. The bowl 23 and trapway 60 may be the same as discussed above with respect to FIG. 9. The toilet 401 further includes a flexible membrane 410 and a housing 405 including a driving magnet 421, and a driven magnet 430. The flexible membrane 410, housing 405, and driven magnet 430 may be the same as described above with respect to FIG. 9.

In this embodiment, the driving magnet 421 is a permanent magnet. For example, the driving magnet 421 may be a rectangular magnet with a south/negative pole located on a first end of the driving magnet 421 and a north/positive pole located on a second end of the driving magnet 421. The driving magnet 421 may be located within the housing 405. The driving magnet 421 may be secured to the housing 405 and/or the bowl 23 via a driving magnet mount 470. The driving magnet mount 470 may comprise a shaft extending from a surface of the housing 405 or the bowl 23 into the housing 405. The driving magnet 421 may be secured to the driving magnet mount 470 such that the driving magnet is free to rotate about its central axis in a first plane (i.e., the x and y plane of FIG. 14).

The driving magnet 421 may be configured to rotate between a first position and a second position. In the first position, the first end of the driving magnet 421, having the south/negative pole, may be the end of the driving magnet 421 disposed closest to the driven magnet 430. The driven magnet 430 may be orientated such that an end of the driven magnet 430 having a north/positive pole is closest to the first end of the driving magnet 421. Accordingly, in the first position, the south/negative pole located on the first end of the driving magnet 421 and the north pole located on the end of the driven magnet 430 closest to the driving magnet 421 are attracted to one another. In the first position, the first end of the driving magnet 421 may be attracted to and disposed closest to the driving magnet 430.

In the second position, the driving magnet 421 may be rotated 180°, so as to have its second end, having the north/positive pole closest to the driven magnet 430. Accordingly, in the second position, the second end of the driving magnet 421, the end having the north/positive pole, may now be disposed closed to the driven magnet 430, which has its north/positive pole disposed closest to the driving magnet 421. Accordingly, the positive end of both the driving magnet 421 and the driven magnet 430 may repel each other in the second position. The repulsive force between the driving magnet 421 and the driven magnet 430 may cause the driven magnet 430 to move away from the driving magnet 421. Movement of the driven magnet 430 relative to the driving magnet 421 may cause the flexible membrane 410 to deform and extend into the trap passageway 61. Accordingly, the flexible membrane 410 may exert a force on a liquid flowing through the trap passageway 61, altering the flow of liquid through the trap passageway 61. The orientation of the poles of the driving magnet 421 and the driven magnet 430 may vary. For example, the driven magnet 430 may be positioned to have an end having its negative pole closest to the driving magnet 421.

In some embodiments, the driving magnet 421 may be connected to a flush actuator such that a mechanical force exerted on the flush actuator (e.g., a button, physical switch) may be used to rotate the driving magnet 421 about its central axis in the first plane. In other embodiments, the driving magnet may be rotated automatically, for example, by an electric motor connected to a controller. FIG. 15, described hereinafter, illustrates an exemplary embodiment of a controller that may be used to control driving magnet 421. In some embodiments, the repulsive force between like poles of the driving magnet 421 and the driven magnet 430 may cause the driving magnet to return to the first position. In another embodiment, an electric motor may cause the driving magnet 421 to return to the first position. In yet another embodiment, an elastic member such as a spring may cause the driving magnet 421 to return to the first position.

FIG. 15 illustrates a controller 301 according to an exemplary embodiment of the present disclosure. The controller 301 may selectively supply electric current to one or more electromagnetic coils of the various embodiments disclosed herein. Additionally, the controller 301 may selectively supply electrical current to one or more electric motors disclosed herein. The controller 301 may include a processor 300, a memory 352, and a communication interface 353 for interfacing with devices or to the internet and/or other networks 346. In addition to the communication interface 353, a sensor interface 354 may be configured to receive data from one or more sensors 111 described herein or data from any source for the position of the user. The components of the control system may communicate using bus 348. The control system (e.g., controller 301) may be connected to a workstation or another external device (e.g., control panel) and/or a database for receiving user inputs, system characteristics, and any of the values described herein.

Optionally, the control system may include an input device 355 and/or a sensing circuit in communication with any of the sensors. The sensing circuit receives sensor measurements from as described above. The input device 355 may include the switch 150, a touchscreen coupled to or integrated with the toilet, a keyboard, a microphone for voice inputs, a camera for gesture inputs, and/or another mechanism.

Optionally, the control system may include a drive unit 340 for receiving and reading non-transitory computer media 341 having instructions 342. Additional, different, or fewer components may be included. The processor 300 is configured to perform instructions 342 stored in memory 352 for executing the algorithms described herein. A display 350 may be supported by the toilet. The display may be combined with the user input device 355.

The controller 301 may receive sensor data indicative of usage of the toilet from one or more sensors 111 through the sensor interface 354. For example, the controller 301 may be in communication with (e.g., via the sensor interface 354) a sensor 111 configured to detect the presence of a user, and in response cause the electromagnet to generate an electromagnetic field in response to a user leaving the vicinity of the toilet.

The sensor interface 354 may be in communication any type of sensor 111 configured to detect certain actions and/or to provide functionality (e.g., dispensing, flushing, etc.) disposed within or proximate to the toilet. The sensor 111 may include any type of sensor configured to detect certain conditions and/or to provide functionality. For example, the sensor 111 may be configured to detect a water level in the bowl 23 or a blockage in the trapway 60. Odor sensors, proximity sensors, and motion sensors are non-limiting examples of sensors 111 that may be employed with the systems of this application. Odor sensors, such as volatile organic compound (VOC) sensors, may be employed to detect organic chemicals and compounds, both human made and naturally occurring chemicals/compounds. Proximity sensors may be employed to detect the presence of an object within a zone of detection without physical contact between the object and the sensor. Electric potential sensors, capacitance sensors, projected capacitance sensors, and infrared sensors (e.g., projected infrared sensors, passive infrared sensors) are non-limiting examples of proximity sensors that may be employed with the systems of this application. Motion sensors may be employed to detect motion (e.g., a change in position of an object relative to the objects surroundings). Electric potential sensors, optic sensors, radio-frequency (RF) sensors, sound sensors, magnetic sensors (e.g., magnetometers), vibration sensors, and infrared sensors (e.g., projected infrared sensors, passive infrared sensors) are non-limiting examples of motion sensors that may be employed with the systems of this application.

In another example, the sensor 111 may include a light detection and ranging (LiDAR) that servers as a proximity sensor. The controller 301 receives sensor data such as a point cloud, from the sensor 111 and analyzes the sensor data to determine when a user is approaching or has approached the toilet.

In another example, the sensor 111 may include a sensor configured to detect a water level. The sensor may include a float sensor, a pressure level sensor, an ultrasonic water level transmitter, a capacitance level sensor (e.g., an RF sensor), and a radar level sensor. Further, an optical sensor may be used to determine a water level.

The processor 300 may be a general purpose or specific purpose processor, an application specific integrated circuit (ASIC), one or more programmable logic controllers (PLCs), one or more field programmable gate arrays (FPGAs), a group of processing components, or other suitable processing components. Processor 300 is configured to execute computer code or instructions stored in memory 352 or received from other computer readable media (e.g., embedded flash memory, local hard disk storage, local ROM, network storage, a remote server, etc.). The processor 300 may be a single device or combinations of devices, such as associated with a network, distributed processing, or cloud computing.

The memory 352 may include one or more devices (e.g., memory units, memory devices, storage devices, etc.) for storing data and/or computer code for completing and/or facilitating the various processes described in the present disclosure. Memory 352 may include random access memory (RAM), read-only memory (ROM), hard drive storage, temporary storage, non-volatile memory, flash memory, optical memory, or any other suitable memory for storing software objects and/or computer instructions. Memory 352 may include database components, object code components, script components, or any other type of information structure for supporting the various activities and information structures described in the present disclosure. Memory 352 may be communicably connected to processor 300 via a processing circuit and may include computer code for executing (e.g., by processor 300) one or more processes described herein. For example, memory 298 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 353 may include any operable connection. An operable connection may be one in which signals, physical communications, and/or logical communications may be sent and/or received. An operable connection may include a physical interface, an electrical interface, and/or a data interface. The communication interface 353 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 352) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The controller 301 may be configured to initiate a flush cycle in response to the sensor data received. Additionally, the controller 301 may be configured to configured to supply a current to one or more electromagnetic coils in response to the sensor data. In some embodiments, the controller may supply a current to one or more electromagnetic coils before initiating a flush cycle and continue to supply electric current to the one or more electromagnetic coils for the duration of the flush cycle. In another embodiment, the controller 301 may be configured to supply current to the one or more electromagnetic coils for one or more predetermined periods of time during the flush cycle. In yet another embodiment, the controller 301 may be configured to supply electric current to the one or more electromagnetic coils after the flush cycle.

The controller 301 may be configured to selectively activate (e.g., supply power) to one or more electromagnetic coils, causing the one or more electromagnetic coils to generate a magnetic field. For example, the controller 301 may activate some electromagnets during a first interval of time and other electromagnets during a second interval of time. The controller may be further configured to active the one or more electromagnetic coils causing the strength of the magnetic field to increase over a period of time (e.g., by increasing the current through the electromagnetic coil). The controller 301 may further be configured to selectively activate and deactivate the one or more electromagnetic coils at one or more predetermined frequencies causing the electromagnetic coil to generate a magnetic field in pulses.

Figure 16:
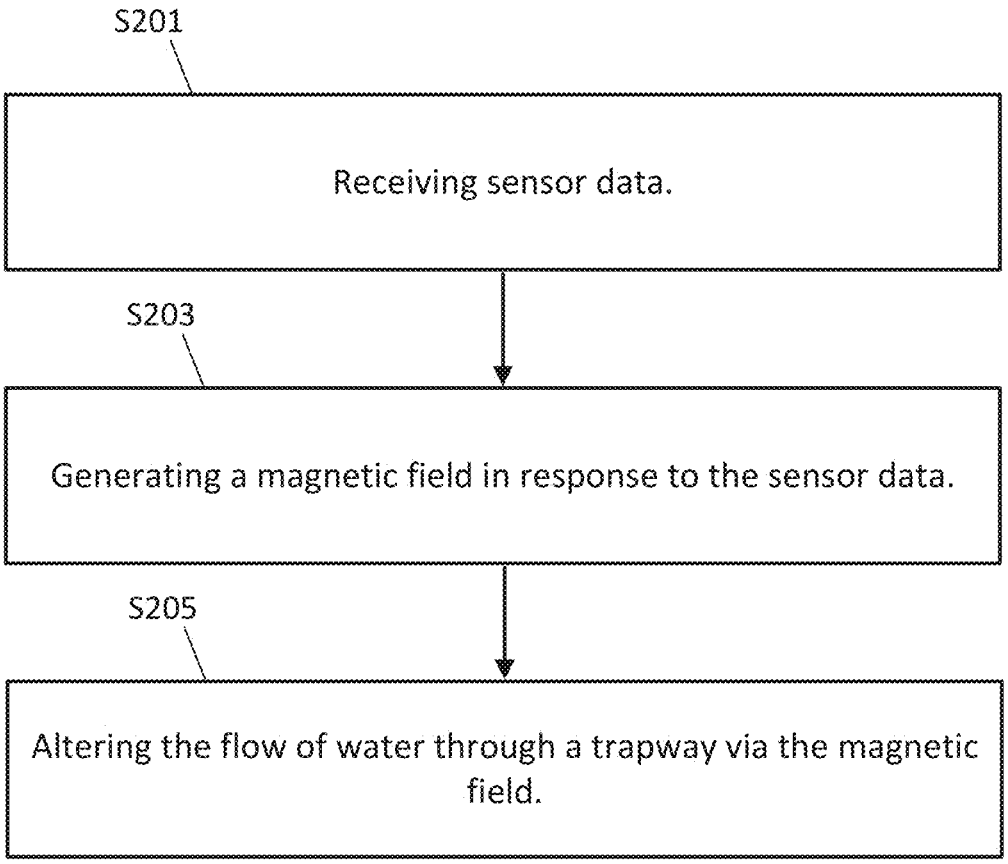
FIG. 16 illustrates a flow chart for the controller of FIG. 14 according to an exemplary embodiment of the present disclosure.

FIG. 16 illustrates a flow chart for generating and applying a magnetic field according to an exemplary embodiment of the present disclosure. The various devices and systems disclosed herein may utilize the method as illustrated in the flow chart of FIG. 16 to generate and apply a magnetic field. Additional, fewer, or different acts may be included.

At act S201, the controller 301 (e.g., through the sensor interface 354) receives sensor data. The sensor data may be indicative of a user, or a body part of the user. For example, the sensor data may indicate that the user is near the toilet, or standing facing the toilet (e.g., a standing urination position). The sensor may further be able to determine usage of a toilet based on the presence of a user and subsequent lack of presence of a user. In another example, the sensor data may be indicative of a water level in the bowl 23. In yet another example, the sensor data may be indicative of a blockage in the trapway 60 of the toilet. The sensor data may be any information sensed by sensor 111 as described above with respect to the controller 301 of FIG. 15. In some embodiments, the sensor data may be displayed on the display 350 of the controller and/or sent to the user via the communication interface 353.

At act S203, a magnetic field is generated in response to the sensor data. The magnetic field may be generated by one or more magnets, comprising one or more electromagnetic coils. The one or more electromagnetic coils may be configured to generate magnetic field(s) when electric current flows through the one or more electromagnets. The flow of electric current to the one or more magnets may be controlled by a switch. Accordingly, at act S203, a switch may be flipped (e.g., moved, operated) in response to the sensor data such that current flows to and through the one or more electromagnetic coils, causing them to generate one or more magnetic fields. The switch may be operated automatically, for example, by the controller 301 in response to the sensor data.

In some embodiments, the controller 301 may initiate a flush cycle of the toilet in addition to allowing electric current to be supplied to one or more electromagnetic coils. The controller 301 may control the supply of current to one or more electromagnetic coils according to one or more predetermined sequences. For example, in one sequence the controller may be configured to supply electric current to one or more electromagnetic coils before a initiating a flush cycle and may continue to supply electromagnetic current to the one or more electromagnetic coils for the duration of the flush cycle. In another sequence, for example, the controller 301 may be configured to supply current to the one or more electromagnetic coils for one or more predetermined periods of time during the flush cycle (e.g., a period of time at the beginning of the cycle and a period of time at the end of the cycle). In another sequence, for example, the controller 301 may be configured to supply electric current to the one or more electromagnetic coils after the flush cycle.

In some sequences, the controller 301 may be configured to selectively supply current to one or more electromagnetic coils and not other electromagnetic coils for predetermined periods of time during a flush cycle. For example, the controller 301 may be configured to supply power to a first and a third electromagnetic coil during a first period of time relative to the flush cycle and to supply power to a second and fourth electromagnetic coil during a second period of time relative to the flush cycle. In another sequence, the controller 301 may be configured to supply current to one or more electromagnetic coils causing the strength of the magnetic field to increase over a period of time (e.g., by increasing the current supplied to the electromagnetic coil). In yet another sequence, the controller 301 may supply current to one or more electromagnetic coils at one or more predetermined frequencies causing the electromagnetic coil to generate a magnetic field in pulses. In some embodiments, one or more of the sequences described above may be combined with another of the sequences described above.

In some embodiments, the controller 301 may be configured to supply current to the one or more electromagnetic coils using one or more predetermined sequences depending on the sensor data received. For example, the controller 301 may be configured to supply current to the one or more electromagnetic coils according to a first sequence in response to sensor data indicating that a user has entered and subsequently left the vicinity or proximity of the toilet and the controller may be configured to supply current to the one or more electromagnetic coils according to a second sequence in response to sensor data indicating that there is a clog in the trapway of a toilet.

In some embodiments, the controller 301, through the user input device 355 or through the network 345, may receive user input including one or more settings (e.g., a sequence, a magnetic field strength) for generation of the magnetic field. In some embodiments, the user input may include a polarity of the magnetic field. The polarity of the magnetic field may impact the direction that liquid having a positive or negative (e.g., partial, or otherwise) charge is repelled and/or attracted. The user input may determine a setting strength for the magnetic field. The field strength may dictate the distance that the liquid is repelled. The field strength may impact the size of droplets that can be repelled. The field strength may impact the speed of the droplets that can be repelled. The field strength may impact the velocity of the droplets that can be repelled. The field strength may impact the type of liquids that can be repelled (e.g., as the concentration of water is lower, a higher field strength may be used).

In some embodiments, the controller 301 may supply current to a driving magnet, such as driving magnet 420, to indirectly alter a flow of liquid through the trapway 60. For example, the controller 301 may supply current to the driving magnet according to one or more sequences, to indirectly alter a flow of water through the trapway.

At act S205, the flow of liquid (e.g., water) through the trapway 60 of the toilet is altered via the magnetic field. A flow of liquid through the trapway, as is present during a flush cycle of a toilet, may be altered as described above with respect to the trapway 60 of FIG. 3. For example, a flow of diamagnetic liquid, such as water, may be repelled by the magnetic field generated by the one or more magnets.

While the present disclosure has been described with reference to several specific embodiments, which are intended to be illustrative only and not to be limiting of the disclosure, it will be apparent to those of ordinary skill in the art that changes, additions, and/or deletions may be made without departing from the spirit and scope of the disclosure.

The foregoing description is provided for clarity of understanding only, and no unnecessary limitations should be understood therefrom, as modifications within the scope of the disclosure may be apparent to those of ordinary skill in the art.

What is claimed is:

1. A toilet comprising:

a bowl having a discharge outlet;

a trapway in fluid communication with the discharge outlet; and at least one magnet configured to generate a magnetic field to directly alter a flow of water through the trapway.

2. The toilet of claim 1, wherein the magnetic field is configured to assist a flow of water through the trapway during a flush cycle.

3. The toilet of claim 1, wherein the at least one magnet is fixed to a pedestal of the toilet proximate to the trapway.

4. The toilet of claim 1, wherein the at least one magnet includes a plurality of permanent magnets, the plurality of permanent magnets being arranged radially around the trapway or along the trapway.

5. The toilet of claim 1, further comprising:

a power source, wherein the at least one magnet comprises an electromagnet powered by the power source.

6. The toilet of claim 5, further comprising:

a switch for activating or deactivating the at least one magnet.

7. The toilet of claim 5, further comprising:

a sensor configured to collect sensor data; and a controller configured to activate or deactivate the electromagnet in response to the sensor data.

8. The toilet of claim 7, wherein the sensor data describes a presence of a user, a water level in the bowl, or a blockage in the trapway.

9. The toilet of claim 7, wherein the controller is configured to activate and deactivate the electromagnet causing the electromagnet to generate a magnetic field in a series of pulses.

10. The toilet of claim 7, wherein the controller is configured to increase a strength of the magnetic field over a period of time.

11. A toilet comprising:

a bowl having a discharge outlet;

a trapway in fluid communication with the discharge outlet;

at least one magnet configured to generate a magnetic field to alter a flow of water through the trapway;

a flexible membrane disposed within the trapway, the flexible membrane forming a portion of an interior surface of the trapway, wherein the at least one magnet includes a driving magnet and a driven magnet, the driven magnet being coupled to the flexible membrane, and wherein the driving magnet is configured to selectively generate a magnetic field repelling the driven magnet and causing the flexible membrane to elastically deform and extend into the trapway, altering the flow of water through the trapway.

12. A method for generation and application of a magnetic field, the method comprising:

receiving sensor data;

generating a magnetic field in response to the sensor data; and directly altering a flow of water through a trapway of a toilet using the magnetic field.

13. The method of claim 12, wherein the magnetic field assists a flow of water through the trapway during a flush cycle.

14. The method of claim 12, wherein the sensor data is indicative of at least one of a presence of a user, a water level in a bowl of the toilet, and a blockage in the trapway.

15. An apparatus for generation and application of a magnetic field in a toilet, the apparatus comprising:

a flexible sleeve; and a magnet secured to the flexible sleeve and configured to generate a magnetic field, the magnetic field altering a flow of water through a trapway of a toilet.

16. The apparatus of claim 15, wherein the magnet includes a series of permanent magnets.

17. The apparatus of claim 15, further comprising:

a power source, and wherein the magnet comprises an electromagnet powered by the power source.

18. The toilet of claim 1, wherein the at least one magnet comprises a plurality of magnets disposed along a length of the trapway.

19. The method of claim 12, wherein the magnetic field is generated by a plurality of magnets disposed along a length of the trapway.

* * * * *